United States Patent [19]

Akasaka

[11] Patent Number: 4,918,892

[45] Date of Patent: Apr. 24, 1990

[54] HARDWARE ASSEMBLY FOR MOUNTING COPING

[76] Inventor: Michio Akasaka, 52 Aka Yamaura, Ooaza Yakushiji Shikatsu-chu, Nishi Kasugai-gun, Japan

[21] Appl. No.: 359,727

[22] Filed: May 31, 1989

[51] Int. Cl.[5] ..... E04H 12/00

[52] U.S. Cl. ..... 52/300; 52/288; 52/60

[58] Field of Search ..... 52/288, 300, 58, 60, 52/98, 94, 656

[56] References Cited

U.S. PATENT DOCUMENTS 4,335,546 6/1982 Kelly ..... 52/58
4,594,818 6/1986 Prestidge ..... 52/58

FOREIGN PATENT DOCUMENTS 960065 6/1964 United Kingdom ..... 52/288

*Primary Examiner*—David A. Scherbel

*Assistant Examiner*—Lan Mai

*Attorney, Agent, or Firm*—Pretty, Schroeder, Brueggemann & Clark

[57] ABSTRACT

An assembly is described for mounting coping on a surface. A first vertical plate includes fastening elements for fastening a first end of a cover thereon and vertical weakness lines for allowing bending of the plate along a vertical line so as to form an angle defined by the bent plate. A second vertical plate includes a fastening element for fastening a second end of a cover thereon and weakness lines for allowing bending of the plate along a vertical line so as to form an angle defined by the bent plate. First and second covers are provided for mounting by their respective ends each to the first and second vertical plates and wherein each cover includes a mating edge for contacting a substantial portion of the mating edge of the other cover when the first and second covers are mounted on the vertical plates and the vertical plates bent to conform to and mounted on a structural body.

5 Claims, 5 Drawing Sheets

HARDWARE ASSEMBLY FOR MOUNTING COPING

BACKGROUND OF THE INVENTION

1. Field of the Invention

This invention relates to hardware for mounting coping, and more specifically to hardware which can be formed and assembled to conform to the shape of the structural body to which the coping is to be mounted.

2. Related Art

When mounting coping on the right angle corner section of a structural body, the edges of the two pieces of coping, cut at 45° angles, are commonly welded together. However, smooth and clean surfaces can not be obtained because of the welding traces left on the surface of the coping when the pieces of coping are welded at the work site. If the coping is welded at the factory, to form a right angle, the coping may not precisely fit the structural body when the corner angle of the body is not exactly 901 °.

In an attempt to solve this problem, a hardware fixture having an approximately square shape was mounted at the corner section of the structural body. Any difference between the angles of the body and the square shape of the fixture was accommodated using putty when the copings, with the edges cut at 45° angles, were placed on the hardware fixture. However, the fixture could not be easily mounted on the body when the difference in angles of the structural body and the hardware fixture were relatively large.

There is a need for coping mounting hardware which can accommodate structural bodies where the corner sections thereof are not true 90° angles. There is also a need for a hardware assembly which can be used to mount coping on a structural body which can still have an aesthetically pleasing appearance.

SUMMARY OF THE INVENTION

An assembly is disclosed which can mount coping pieces at the corner of a structural body wherein the coping pieces are cut at 45° and wherein the relative angle of the structural body is not exactly 90°. The assembly allows for mounting of the coping pieces in an aesthetically pleasing manner. The assembly includes a first vertical plate including means for fastening a first end of a cover thereon and means for allowing bending of the plate along a vertical line so as to form an angle defined by the bent plate. A second vertical plate includes means for fastening a second end of a cover thereon and means for allowing bending of the plate along a vertical line so as to form an angle defined by the bent plate. First and second covers to be mounted by the respective ends each to the first and second vertical plates are provided wherein each cover includes a mating edge for contacting a substantial portion of the mating edge of the other cover when the first and second covers are mounting on the vertical plates and when the vertical plates are bent to conform to and are mounted on a structural body. In a preferred configuration, the vertical plates include a first weakness line on one side of the plate for bending the plate at an approximate center thereof and an additional weakness line on the opposite side of the plates and on each side of the first weakness line for bending the plates on each side of the center.

DETAILED DESCRIPTION OF THE PREFERRED EMBODIMENT

Figure 1:
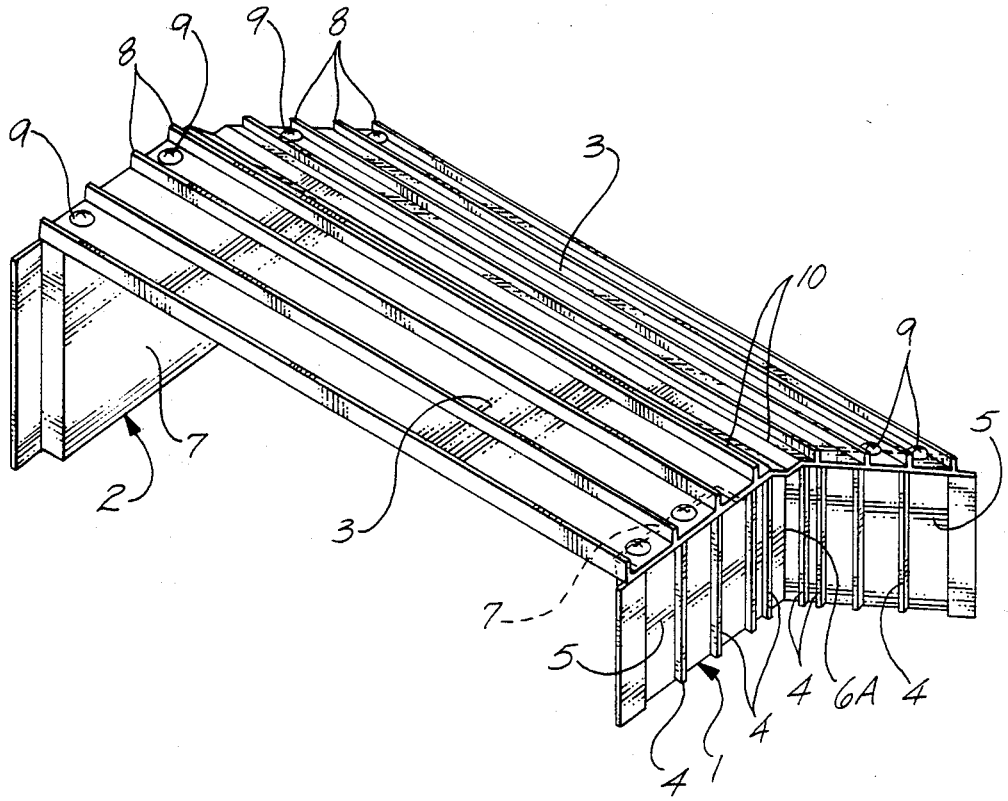
FIG. 1 is an oblique view of a hardware assembly according to the present invention for mounting coping on a structural body.
Figure 4:
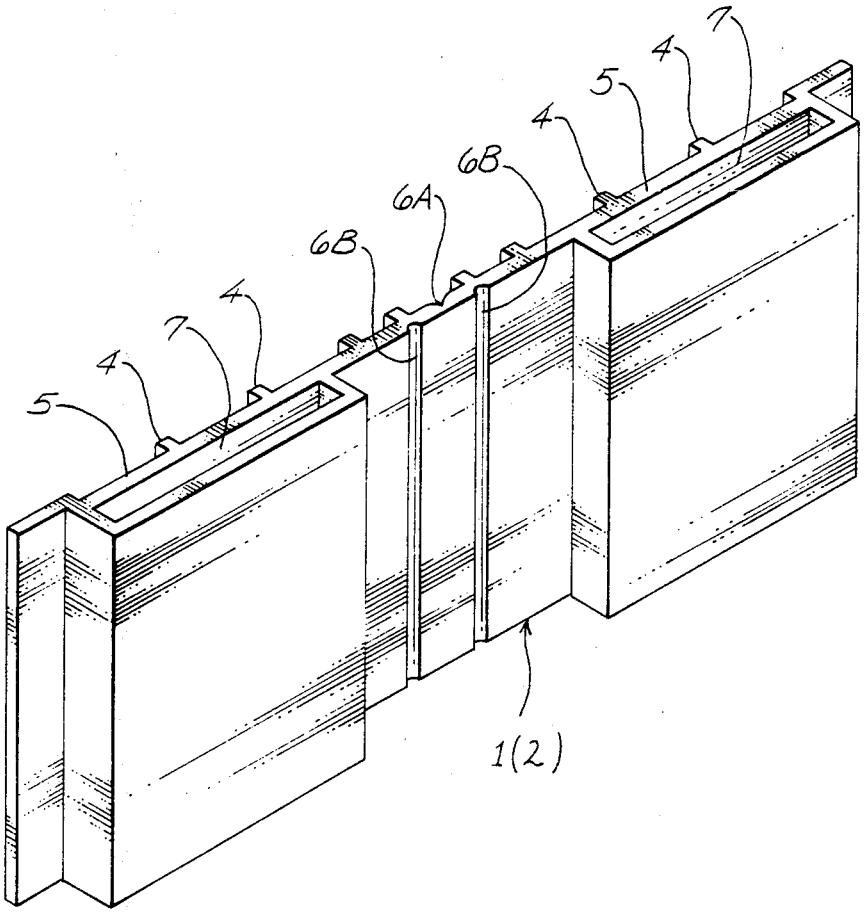
FIG. 4 is an oblique view of an unbent vertical plate to be used in the hardware assembly of FIG. 1.

An assembly for mounting coping on a surface includes a first vertical plate 1 and a second vertical plate 2 and a set of covers 3 forming an assembly for mounting coping on a structural body. (See FIG. 1.) Each vertical plate is substantially the same as the other except that the vertical plates are bent in different directions. Considering FIG. 4, each vertical plate initially forms a relatively straight member having a plurality of vertical reinforcing ribs 4 extending vertically along one side of the plate and spaced apart from one another longitudinally. Each vertical plate includes first and second sides 5 forming an angle therebetween when bent as described below. The plates will be bent in order to conform the plate to the angle or corner section of the structural body on which the coping is to be mounted. Score lines or weakness lines 6A and 6B are formed vertically in the support plates to facilitate bending of the plates into the desired angular configuration. The weakness line 6A is formed on one side of the support plate, preferably the same side as the ribs 4. The weakness line 6A is formed at the center so that the sides of the support plate can be bent to form an angle centered on the weakness line 6A. The ribs 4 would then be on the interior of the angle. The first vertical plate 1 shown in FIG. 1 is bent in this manner.

Figure 2:
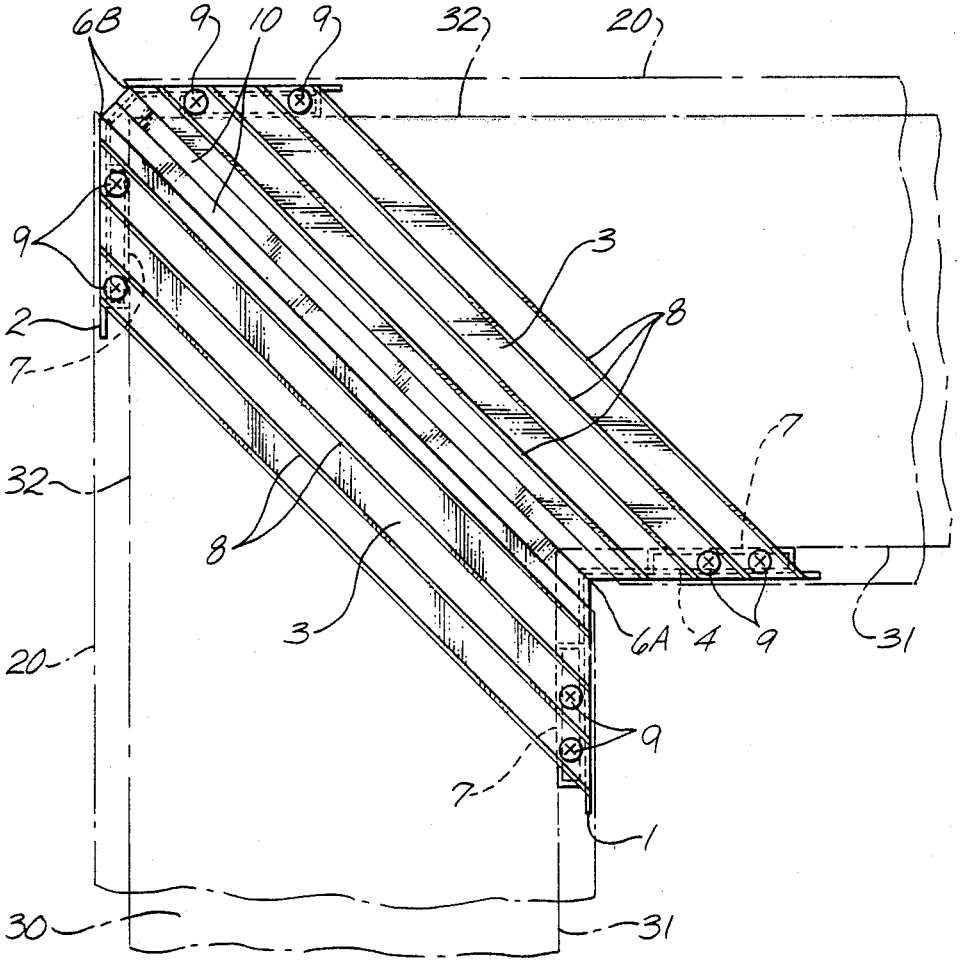
FIG. 2 is a top plan view of the assembly of FIG. 1.
Figure 3:
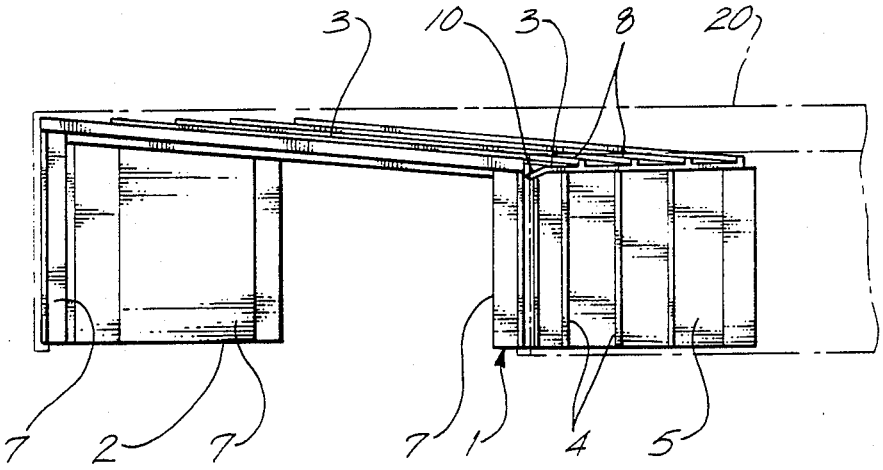
FIG. 3 is a front elevation view of the hardware assembly of FIG. 1.

An additional pair of score lines or weakness lines 6B are formed on the side of the vertical plate opposite the center weakness line 6A and are placed equidistant from the center line. The weakness lines extend from top to bottom of the vertical plate. The weakness lines facilitate bending of the sides 5 of the support plate into an angle conforming preferably to the outside corner of the structural body on which the coping pieces are to be mounted. In this configuration, the vertical plate corresponds to the vertical plate 2 shown in FIGS. 1 and 2. As can be seen in FIG. 2, the vertical support plate 2 is bent into a three sided figure by bending at the two weakness lines 6B.

Each vertical support plate includes tap bolt feed-throughs 7 formed on each side 5 of the vertical plates opposite the reinforcing ribs 4. The bolt feed-throughs preferrably extend from the top to the bottom of the support plate. The first vertical plate 1 is preferably attached to the inside surface 31 of the corner section of the body 30 (FIG. 2) and the second vertical plate 2 is preferably attached to the outside surface 32 of the corner section.

Figure 5:
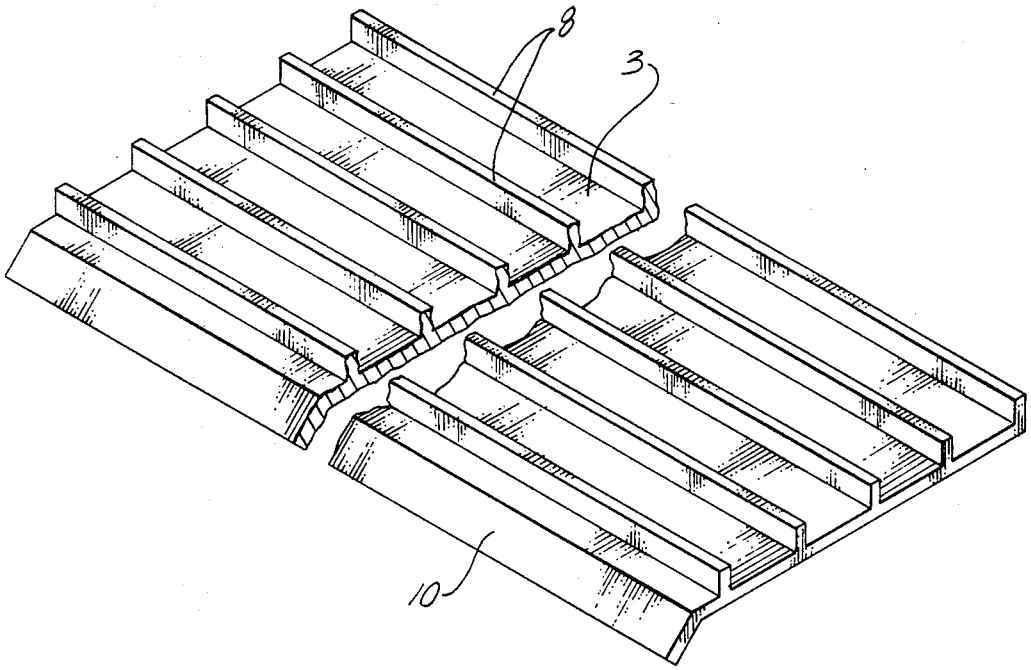
FIG. 5 is an oblique view of a cover plate to be used with the assembly of FIG. 1.

The covers 3 (FIG. 5) are parallelograms configured to the planar shape shown in FIG. 2. The cover plate includes longitudinally extending, spaced apart reinforcing ribs 8 on the top. The reinforcing ribs extend parallel to two of the sides of the parallelogram-shaped cover. Each cover includes a downwardly sloping or angled mating edge 10 extending downward and away from the top of the cover for mating with a corresponding angled edge on the other cover 3. The mating edge extends substantially the length of one side of the parallelogram.

To assemble the vertical support plates and covers, the first and second vertical support plates are bent along the bending lines 6A and 6B, respectively, until they conform to the shape of the corner section. The first and second vertical support plates 1 and 2 will then have the configuration shown in FIG. 2. Two cover plates are then placed over the top edges of the support plates and attached thereto using tap bolts 9. Specifically, one cover is placed over corresponding sides of the first and second support plates and the second cover is placed over the remaining corresponding sides of the first and second support plates so that the mating edges of the two covers are in mutual contact. The covers are screwed onto the tops of the vertical plates by inserting the tap bolts 9 through the bolt feed-through section 7 of each end of the vertical plates. The bolts are passed through the covers by suitable means as would be known to one skilled in the art. Because the structural body 30 on which the assembly and therefore the coping pieces are to be mounted may not form a precise 90° angle, the two covers, when brought close together, may not uniformly meet each other when forming the connection between them. However, the mating edges 10 accommodate the variation in the angle through an appropriate overlap of one mating edge over the other.

Because the coping mounting hardware according to the present invention is fitted to the structural body, using the standard methods known in the art, after being matched to the shape of the corner of the structural body on the work site, minute adjustments of the angles of the mounting hardware can be easily performed at the work site. Additionally, because the two covers are fastened down over the vertical plates with their mating edges brought firmly together, the corners of the coping pieces 20, as seen in phantom in FIG. 2, can be finished to produce an aesthetically pleasing look by covering any gap with putty after placing the two coping pieces (with adjacent edges cut at 45°) over the covers 3. Additionally, the bolt feed-throughs 7 in the vertical plates allow easy assembly at the work site.

The entire assembly, including the vertical support plates and the covers are preferably made from pressed material such as aluminum alloy.

The final assembly is shown in FIG. 2, partly in phantom, as viewed from the top. Considering the elements sown in FIG. 2 from the bottom up, the structural body 30 includes an inside surface of the corner section 31 and an outside surface 32. The first vertical support plate is bent and mounted to the inside corner of the body, while the second vertical support plate is bent and mounted to the outside corner as shown. In both instances, the bolt feed-throughs 7 are in contact with the surfaces of the structural body. The cover plates 3 are mounted to the tops of the structural support plates using the tap bolts 9. Two coping pieces 20, whose mating edges are cut at 45° angles, are then placed over the structural body and the cover plates 3. Putty may then be applied in the gap between the coping sections and over the mating edges 10 of the cover plates.

With the disclosed invention, a coping mounting assembly is described which provides easy formation of the assembly at the work site and mounting thereof on a structural body in spite of any differences in the angle of the structural body from exact 90°. The elements of the assembly can be combined in such a way that the coping pieces, while the edges of the sections are cut at 45°, can be joined in an aesthetically pleasing manner.

Although the present invention has been described in detail with reference only to the presently preferred embodiments, it will be appreciated by those of ordinary skill in the art that various modifications can be made without departing from the invention. Accordingly, the invention is limited only by the following claims.

I claim:

1. Assembly for mounting coping on a surface comprising:

a first vertical plate including means for fastening a first end of a cover thereon and means for allowing bending of the plate along a vertical line so as to form an angle defined by the bent plate;

a second vertical plate including means for fastening a second end of a cover thereon and means for allowing bending of the plate along a vertical line so as to form an angle defined by the bent plate; and first and second covers to be mounted by their respective ends each to the first and second vertical plates and wherein each cover includes a mating edge for contacting a substantial portion of the mating edge of the other cover when the first and second covers are mounted on the vertical plates and the vertical plates bent to conform to and mounted on a structural body.

2. The assembly of claim 1 wherein each vertical plate includes a first weakness line on one side for bending the plate at an approximate center thereof and an additional weakness line on the opposite side of the plates and on each side of the first weakness line for bending the plates on each side of the center.

3. The assembly of claim 1 wherein mounting means on the vertical plates comprises bolt feed-throughs on one side of each vertical plate.

4. The assembly of claim 1 wherein the mating edges include slanted edges extending below the cover and extending substantially a length of the cover.

5. The assembly of claim 1 wherein the assembly, when fully assembled and mounted on a structural body, includes the first and second vertical plates bent so that the sides of each plate are at approximately right angles with respect to each other and the covers are mounted to the vertical plates such that the mating edges are in mutual contact over a substantial length of the covers.

* * * * *